US007699796B2

(12) United States Patent
Olson

(10) Patent No.: US 7,699,796 B2
(45) Date of Patent: Apr. 20, 2010

(54) ERGONOMIC REFLEXOLOGY DEVICE

(76) Inventor: Chuck Olson, 1535 Bell Oaks Dr., Bellville, TX (US) 77418

( * ) Notice: Subject to any disclaimer, the term of this patent is extended or adjusted under 35 U.S.C. 154(b) by 699 days.

(21) Appl. No.: 10/760,018

(22) Filed: Jan. 20, 2004

(65) Prior Publication Data

US 2005/0159689 A1 Jul. 21, 2005

(51) Int. Cl.
*A61H 19/00* (2006.01)

(52) U.S. Cl. ..... 601/134; 601/135

(58) Field of Classification Search ..... 601/134–138; 604/204

See application file for complete search history.

(56) References Cited

U.S. PATENT DOCUMENTS 4,041,962 A * 8/1977 Johansson et al. ..... 132/323
4,483,328 A * 11/1984 Wolocko ..... 601/135
6,254,555 B1 * 7/2001 Sevier et al. ..... 601/135
2003/0114781 A1 * 6/2003 Beaty et al. ..... 601/135

* cited by examiner

*Primary Examiner*—Michael A. Brown
(74) *Attorney, Agent, or Firm*—Delphine James

(57) ABSTRACT

The present invention is a hand-held ergonomic reflexology device. The device includes a semi-cylindrical shape handle dimensioned to fit within the palm of the user's hand. The handle is defined by a first end, an opposite second end, inner edge and a outer edge. A thumb support member is integrally connected to the handle and protruding outwardly to the sensor tip portion. The sensor tip portion is adapted to apply direct pressure to predetermined reflex points on the body. The thumb support member has substantially an elliptical shape and is defined by an upper surface area, an inner curved peripheral edge, and a outer curved peripheral edge. The upper surface area has a circumference dimensioned to fit a thumb of the user's hand. The inner curved peripheral edge extends from the sensor tip portion to the inner edge of the handle and is integrated therein. The outer curved peripheral edge extends from the tip portion to the outer edge of the handle and transitions into an arc therein, whereby the hand-held device has a structure resembling a small handgun.

18 Claims, 3 Drawing Sheets

ERGONOMIC REFLEXOLOGY DEVICE

BACKGROUND

The present invention relates to a device for applying pressure to acupressure points on the human body and more particularly a hand-held pressure-applying device for stimulation of reflex points using reflexology. Reflexology is a term that refers to the stimulation of the feet, hands or ears in order to affect other parts of the body via specific points that are called micro-systems. Microsystems are described as a map of the entire body. Reflexology treatments can help to relieve stress, muscular tension, improve blood flow and circulation and encourage the unblocking of energy/nerve pathways.

Various devices have been developed for applying acupressure to the human body. For example, U.S. Pat. No. 5,695,520 to Bruckner et al. shows a pressure-applying device for relieving distress that includes a pressure applicator having a plate member and a pressure-applying body attached to and protruding from one of a pair of opposite surface of the plate member. U.S. Pat. No. 6,007,503 to Berger, et al. shows an acupressure device adapted for use as an anti-nausea prophylactic. U.S. Pat. No. 4,479,495 to Issacson shows an acupressure device that comprises a stimulator attached to a flexible cinching strap or hand.

What is needed is a simple hand-held reflexology device that can be used as an effective tool in treatments while relieving the stress caused by manual hand manipulation.

SUMMARY

The apparatus of the present invention is a hand-held pressure-applying ergonomic reflexology device for reflex stimulation. In the preferred embodiment of the present invention, the hand-held device comprises a handle having an integrated thumb support member at one end. Thumb support member further comprises a groove within its upper surface area dimensioned to accommodate the bottom surface of the user's thumb. At the apex point of thumb support member, a sensor tip portion is formed from a small protruding blunted end. The entire hand-held device is dimensioned to fit within the palm of the user's hand. In use, the thumb is held in the groove of the thumb support member of the hand-held device while pressure is applied with the sensor tip or blunt end of the device to specific areas of the body for the relief of stress as well as enhancing the body's own healing process. The present invention can be carved from wood or molded of plastic, has the appearance of a small handgun, and can be manufactured for small, medium, and large hand sizes as well as for both left and right handed users.

BRIEF DESCRIPTION OF DRAWINGS

The drawings and the accompanying description illustrate the present invention.

DETAILED SPECIFICATION

Figure 1:
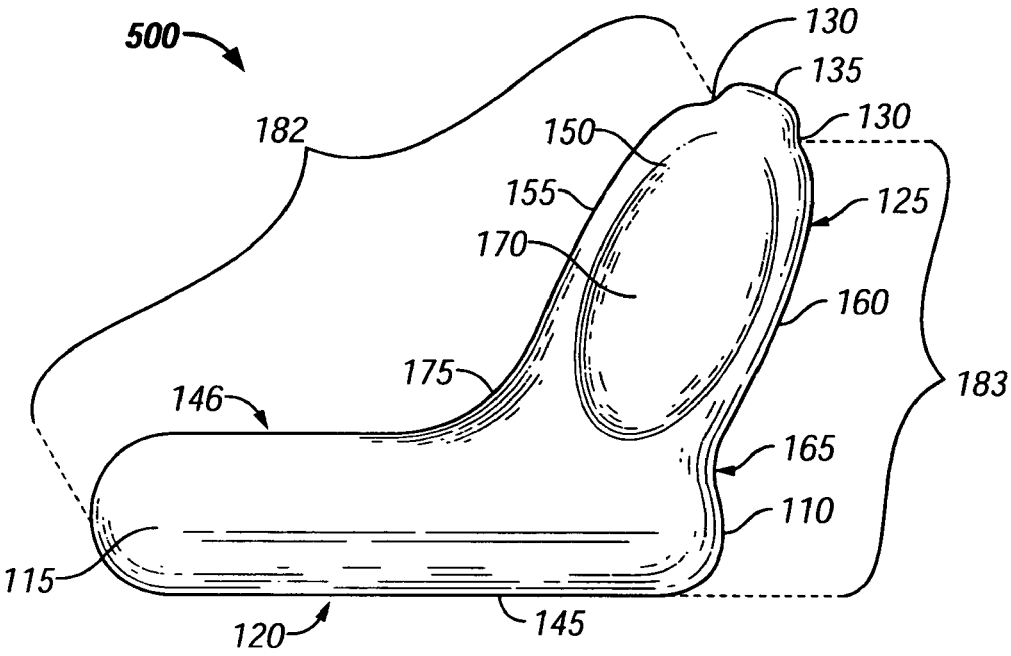
FIG. 1 is a frontal view of the preferred embodiment of the present invention, an ergonomic reflexology device.

Referring to FIG. 1, there is shown a side perspective view of the preferred embodiment of the present invention, a hand-held ergonomic reflexology device (500). This embodiment of the hand-held ergonomic reflexology device further comprises a semi-cylindrical handle (120) dimensioned to fit within the palm of the user's hand. The handle (120) is defined by the first end (110), an opposite second end (115), and inner edge (146) and an outer edge (145). As illustrated, this embodiment of the present invention further includes a thumb support member (125) integrally connected to the handle (120) with at least a 15° angle. The thumb support member (125) protrudes outwardly from the handle (120) to an apex point, tip portion (130). The hand-held device (500) can be made of a smooth solid rigid material such as wood or plastic or another such compatible material.

In the preferred embodiment, thumb support member (125) has substantially an elliptical shape that is partially enclosed. However, thumb support member (125) can be adapted into alternative appropriate shapes that could accommodate the present invention. Thumb support member (125) is further defined by an upper surface area (150), an inner curved peripheral edge (155), and an outer curved peripheral edge (160). Upper surface area (150) is dimensioned to accommodate the circumference of the user's thumb. Additionally, upper surface area (150) can be dimensioned to fit the left or right thumb of the user as well as accommodate small, medium and large hand sizes.

In the illustrated embodiment, the thumb support member (125) further comprises a groove (170) forming an indention within the central portion of the upper surface area (150). Groove (170) has sufficient depth dimensioned to accommodate the bottom surface of a user's thumb and provides the support for the thumb while the user is applying pressure to reflex points on the body. Additionally, with this kind of embodiment, thumb support member (125) is ergonomically designed such that the tip of the user's thumb does not have to touch the body during use.

In the illustrated embodiment in FIG. 1, the inner curved peripheral edge (155) of the thumb support member (125) extends from the tip portion (130) to an intermediate position along inner edge (146) of the handle (120). At the point of juncture between the inner edge (146) of the handle (120) and the inner curved peripheral edge (155), the handle (120) integrates into the thumb support member (125) and transitions into arc (175). The outer curved peripheral edge (160) of the thumb support member (125) extends from the tip portion (130) to the first end (110) of the handle (120). At the point of juncture between the first end (110) of the handle (120) and the outer curved peripheral edge (160) of the thumb support member (125) transitions into arc (165). The outer peripheral edge (183) extends from tip portion (130) through the outer curved peripheral edge (160) of thumb support member (125) and the first end (110) of handle (120), including arc (165). In this embodiment, the inner peripheral edge (182) extends from tip portion (130) through the inner curved peripheral edge (155) of handle (120) all the way to the opposite second end (115) of handle (120), as shown, including arc (175) and inner edge (146) of handle (120). The overall structure of hand-held device (500) resembles a small handgun.

Figure 2:
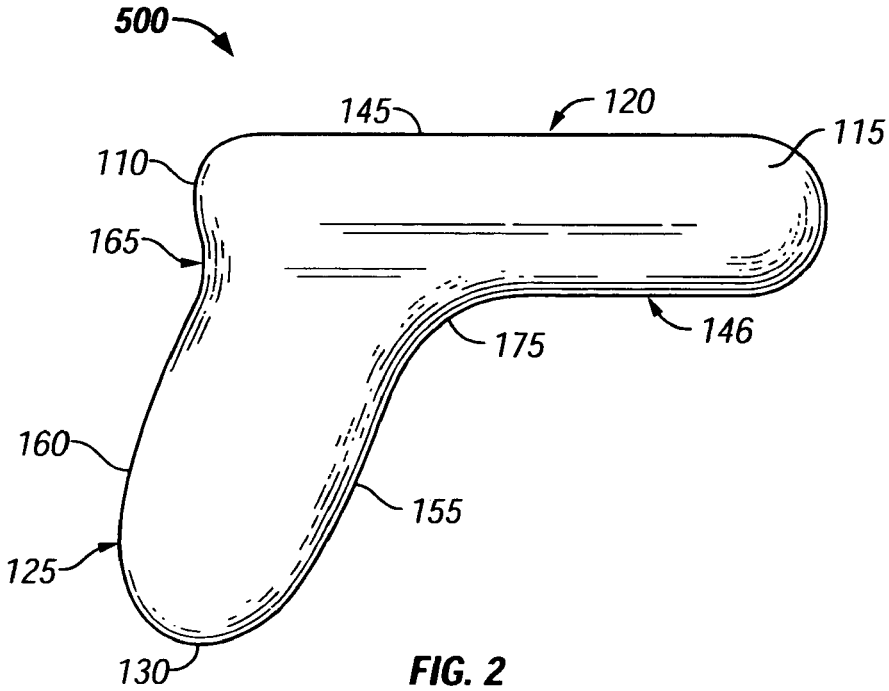
FIG. 2 is a frontal view of an alternative embodiment of the present invention, an ergonomic reflexology device.

In the illustrated embodiment in FIG. 1, tip portion (130) is adapted with a smaller blunt end sensor tip portion (135). In this kind of embodiment, sensor tip portion (135) is specifically designed to enhance the transmission of the proprioceptive sensitivity. Referring now to FIG. 2, there is shown an alternative embodiment of the present invention. In this embodiment, tip portion (130) has a smooth rounded edge. Here, in this illustrated embodiment, tip portion (130) is absent the above mentioned blunt end (135) as shown in FIG. 1, providing a universal interchangeable thumb support member (125) which can be easily switched between the left and right hand.

The hand-held device of the present invention further comprises a means for maintaining the proprioceptive sensitivity as it is directed through the sensor tip portion (135) into the thumb support member (125) and then, into the hand and the forearm in this kind of embodiment groove (170). The groove (170) in the thumb support member (125) is egonomically designed such that the tip of the thumb does not have to touch the body. The ergonomic design of reflexology device (500) in conjunction with the material utilized maximizes and maintains the proprioceptive sensitivity. The material utilized should have the capability of increasing the transmission of the proprioceptive sensitivity through the thumb support member (125) into the user's hand and forearm. The present invention can be made of wood or plastic, each of which has the characteristic and capability of transmitting the proprioceptive sensitivity through the thumb support member (125) into the user's hand and forearm.

Figure 3:
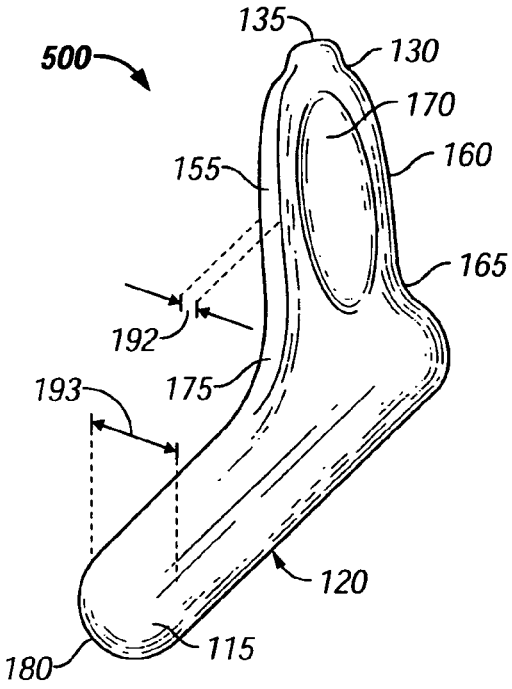
FIG. 3 is an exploded angle view of the preferred embodiment of the present invention.

Referring to FIG. 3, there is shown an exploded angle front view of device (500). Device (500) also, is ergonomically designed to be utilized to stimulate other parts of the body. First, the second end of the handle (115) can be adapted with a rounded blunt end (180) of a diameter of at least $\frac{1}{8}^{th}$ inch. The rounded blunt end (180) can be utilized to apply pressure to predetermined trigger points of the human body.

Referring to FIG. 3, the inner peripheral edge (182) of device (500) can be adapted with sufficient depth so the entire inner peripheral edge (182) can be utilized to apply pressure to predetermined small stripping areas of the human body. The inner curved peripheral edge has a depth of at least $\frac{1}{8}^{th}$ inch and the inner edge (146) of handle (120) has a depth of at least $\frac{1}{8}^{th}$ inch.

Lastly, the outer peripheral edge (182) of device (500) can be adapted with sufficient depth so that the entire outer peripheral edge (182) can be utilized to apply pressure to predetermined large stripping areas of the thumb support member (125). In FIG. 3, device (500) has a uniform depth along the circumference of the thumb support member (125) and handle (120). Thus, outer curved peripheral edge (160) also has a depth of at least $\frac{1}{8}^{th}$ inch and the first edge (110) of handle (120) also has a depth of at least $\frac{1}{8}^{th}$ inch.

Figure 4:
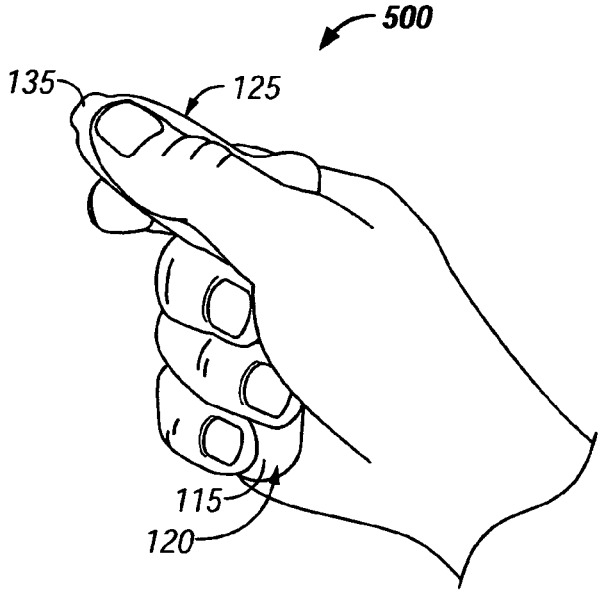
FIG. 4 is an illustration of the typical reflexology grip of the present invention.

Referring to FIG. 4, there is shown the typical reflexology grip for the present invention. In order to use the hand-held device (500) with this grip, the user grasps the handle (120) in the palm of the user's hand with the middle, ring and pinky fingers. The handle (120) is placed in the palm of the hand in a vertical position. The bottom surface of the thumb is placed in the center portion of the thumb support member (125) with the index finger providing support to the backside of the thumb support member (125). The user locates the reflex points on the body. Pressure is applied to each located reflex point with the sensor tip portion (135) of the thumb support member (125). Generally, varying pressure techniques are applied to the reflex point by rotating the forearm 180° from right to left while locating a tender point and holding the pressure over the tender point until the pain level subsides. Pressure is repeatedly applied to all predetermined reflex points on the body until the desired treatment is achieved. This grip is generally utilized for small size reflex points, which are generally found on the hands and feet, for instance, the pineal gland, pituitary gland, or the spleen.

Figure 5:
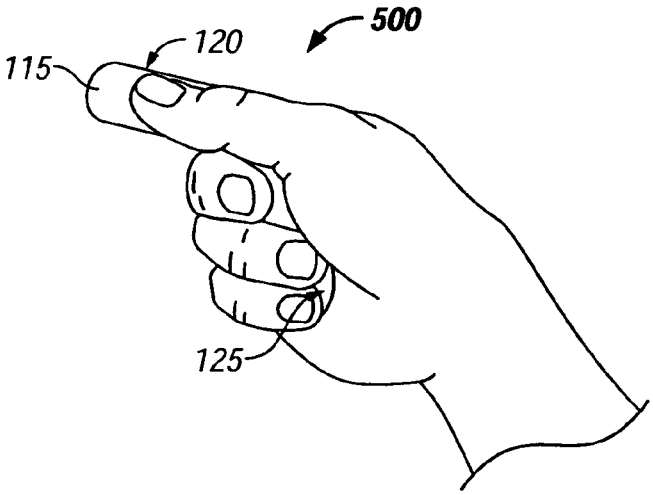
FIG. 5 is an illustration of the trigger point grip of the present invention.

Referring to FIG. 5, there is shown the triggerpoint grip for the present invention. The typical triggerpoint grip resembles the grip for a small pistol. In order to use the hand-held device (500) with this grip, the user first grasps the thumb support member (125) in the palm of the hand with the middle, ring and pinky fingers. Then, the bottom surface of the thumb is placed in the center portion of the front side of the handle (120) with the index fingers supporting the backside of the handle (120). The user located the triggerpoints on the body. Generally, sustained pressure is applied to each located triggerpoint with the rounded blunt end (180) located at the second end (115) of the handle (120). Sustained pressure is repeatedly applied to all predetermined triggerpoints on the body until the desired treatment is achieved. Normally, this grip is utilized for triggerpoints located any where on the body and for general to large specific reflex point work.

Figure 6:
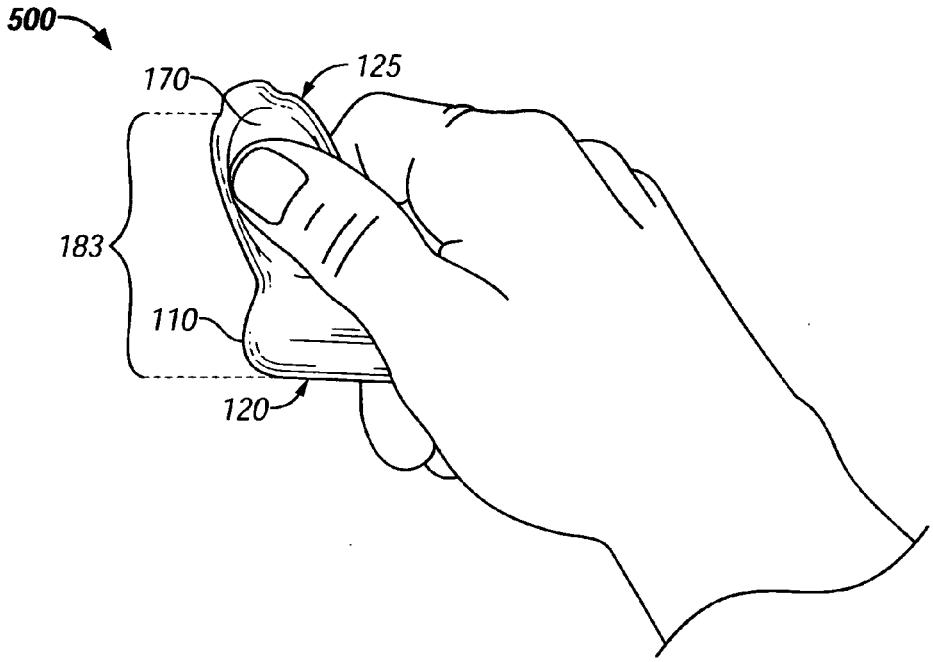
FIG. 6 is an illustration of the small stripping grip of the present invention.

Referring to FIG. 6, there is shown the small stripping grip for the present invention. Stripping is the concentrated application of gliding pressure to the muscle or muscle group with the intent of forcing the lactic acid or the metabolic wastes from the muscle. The small stripping grip is for small to medium muscle or muscle groups such as the soles of the feet, palms of the hand, forearm flexors and extensors, biceps, triceps, neck, or trapezius. Normally, stripping is done utilizing the fours knuckles held tightly together or another similar technique. In order to use the hand-held device (500) with this grip, the user grasps the handle in the palm of the hand with the middle, ring, pinky, and index fingers supporting the back side of the handle (120). The handle (120) is placed in the palm of the hand in a horizontal position. The outer side of the user thumb is placed diagonally across the lower portion of the thumb support member (125) as shown in FIG. 6. The user locates the stripping area on the body. Generally, gliding pressure is applied to each located stripping area with the outer curved edge (160) of the thumb rest member (125). Gliding pressure is applied from the point of origin of the muscle to the point of insertion of the muscle. Gliding pressure is repeatedly applied to all predetermined small stripping areas with the outer peripheral edge of the thumb support member (125), until the desired results are achieved.

Figure 7:
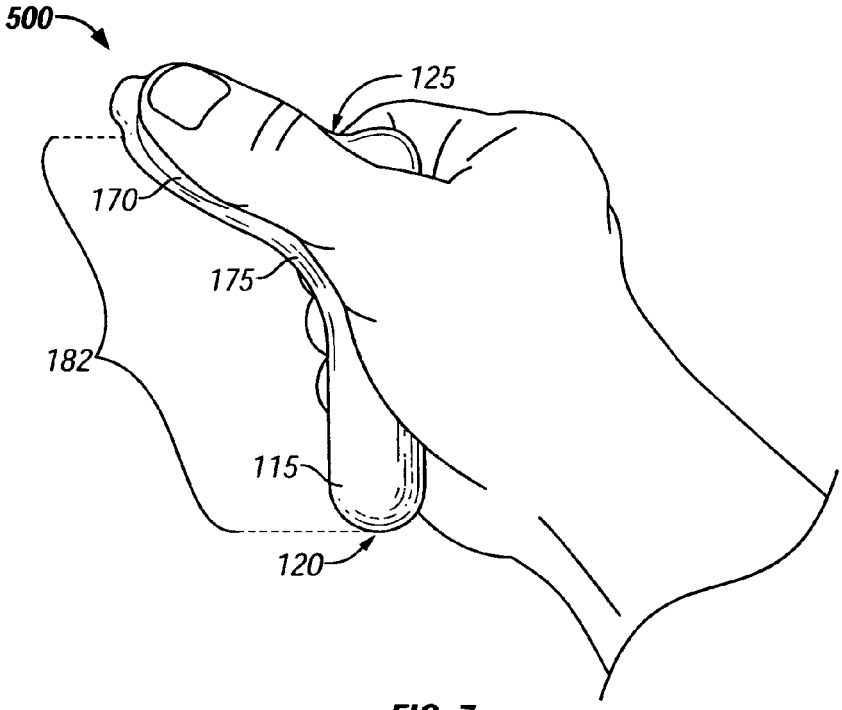
FIG. 7 is an illustration of the large stripping grip of the present invention.

Referring to FIG. 7, there is shown the large stripping grip for the present invention. The large stripping grip is for larger muscles or muscle groups such as the calves, hamstrings, and thighs. In order to use the hand-held device (500) with this grip, the user grasps the upper portion of the handle in the palm of the hand with the middle, ring, pinky, and index fingers supporting the back side of the upper portion of handle (120) near the point of integration between the handle (120) and the thumb support member (125). The handle (120) is placed in the palm of the hand in a vertical position. The bottom surface of the user thumb is placed within groove (170) of thumb support member (125) as shown in FIG. 7. The user locates the stripping area on the body. Generally gliding pressure is applied to each located stripping area with the inner curved peripheral edge (155) of the thumb support member (125) until the desired treatment is achieved. Gliding pressure is applied from the point of origin of the muscle to the point of insertion of the muscle. Gliding pressure is repeatedly applied to all predetermined large stripping areas with the inner peripheral edge of the thumb support member (125), until the desired results are achieved.

What is claimed is:

1. A hand-held ergonomic reflexology device comprising: a handle, defined by an inner edge, lower edge, first end and opposite second end; a thumb support member being integrally connected to the first end of the handle in a substantially perpendicular relationship to a longitudinal axis of the handle-and protruding outwardly laterally along the inner edge near a distal end of the first end therefrom to a sensor tip portion having a semi-spherical shape extending beyond an outer peripheral edge of the thumb support member forming an apex point, the sensor tip portion being adapted to apply direct pressure to predetermined treatment areas on the body and the thumb support member being dimensioned to support the circumference of a user's thumb wherein while in use the user thumb rests in a natural position parallel to the plane of the palm and a groove formed in said thumb support, said groove forming an indentation and being of a width that extends along a substantial width between the edges of said thumb support in order to accommodate the width of the user's thumb.

2. The hand-held device of claim 1 wherein the handle is cylindrical.

3. The hand-held device of claim 2 the handle and the thumb support member being dimensioned to fit within a user's hand, the groove of said thumb support member has a substantially partially enclosed elliptical shape being defined by and upper surface area disposed opposite a lower surface area, an inner curved peripheral edge extending from the tip portion proximally near the upper end of the outer edge of the handle and the inner curved peripheral edge extending from the tip portion to and arc therein.

4. The hand-held device of claim 3, further comprising a means for transmitting the propriceptive sensitivity from the sensor tip portion into the user's hand and forearm as pressure is applied to treatment area on the body.

5. The hand-held device of claim 4, wherein the hand and thumb support member is made of a smooth, solid, rigid material.

6. The hand-held device of claim 5, wherein said, smooth, solid, rigid material is wood.

7. The hand-held device of claim 5, wherein said, smooth, solid, rigid material is plastic.

8. The hand-held device of claim 1, wherein the thumb support member and the handle is dimensioned to fit a small, medium or large hand size.

9. The hand-held device of claim 1, wherein the end of the handle is a rounded, blunt end for applying direct pressure to predetermine treatment areas on the human body.

10. The hand-held device of claim 1, further comprising a means for transmitting the proprioceptive sensitivity from the sensor tip portion into the user's hand and forearm as pressure is applied to treatment areas on the body.

11. The hand-held device of claim 10, wherein the thumb support member and the handle is configured and sized to fit a small, medium or large size hand.

12. The hand-held device of claim 11, wherein the opposite end of the handle has a round blunt end for applying direct pressure to predetermined treatment areas on the human body.

13. The hand-held device of claim 12, further comprising an inner peripheral edge extending from the tip portion through an inner peripheral curved edge of the thumb support member and the inner edge of the handle and ending at the opposite end of the hand.

14. The hand-held device of claim 1, wherein the thumb support member is sized and configured to accommodate the thumb of the right hand or left hand.

15. A method of applying pressure to reflex points of the human body utilizing a hand-held device comprising a handle, defined by an inner edge, lower edge, first end and opposite second end; a thumb support member being integrally connected to the first end of the handle in a substantially perpendicular relationship to a longitudinal axis of the handle-and protruding outwardly laterally along the inner edge near a distal end of the first end therefrom to a sensor tip portion having a semi-spherical shape extending beyond an outer peripheral edge of the thumb support member forming an apex point, the sensor tip portion being adapted to apply direct pressure to predetermined treatment areas on the body and the thumb support member being dimensioned to support the circumference of a user's thumb wherein while in use the user thumb rests in a natural position parallel to the plane of the palm and a groove formed in said thumb support, said groove forming an indentation and being of a width that extends along a substantial width between the edges of said thumb support in order to accommodate the width of the user's thumb, protruding outwardly laterally along an inner edge near a distal end of the first end therefrom, the method comprising (a) locating a reflex point on the human body; (b) grasping the handle with the pinky, middle, and ring fingers of the user's hand with the handle in a vertical position in the palm of the user's hand therein, (c) placing the index finger on the backside of the thumb support member, (d) placing the bottom surface of the thumb in the center portion of the thumb support member, (e) applying adequate pressure to the located reflex point of the body with the tip portion of the thumb support member and (f) repeating step (e) until adequate treatment is applied to all predetermined reflex points of the body.

16. A method of applying pressure to reflex points of the human body utilizing a hand-held device comprising a handle, defined by an inner edge, lower edge, first end and opposite second end; a thumb support member being integrally connected to the first end of the handle in a substantially perpendicular relationship to a longitudinal axis of the handle-and protruding outwardly laterally along the inner edge near a distal end of the first end therefrom to a sensor tip portion having a semi-spherical shape extending beyond an outer peripheral edge of the thumb support member forming an apex point, the sensor tip portion being adapted to apply direct pressure to predetermined treatment areas on the body and the thumb support member being dimensioned to support the circumference of a user's thumb wherein while in use the user thumb rests in a natural position parallel to the plane of the palm and a groove formed in said thumb support, said groove forming an indentation and being of a width that extends along a substantial width between the edges of said thumb support in order to accommodate the width of the user's thumb, protruding outwardly laterally along an inner edge near a distal end of the first end therefrom, the method comprising; (a) locating a trigger point on the human body; (b) grasping the thumb support member with the pinky, middle, and ring fingers of the user's hand with the thumb support member being in the palm of the user's hand therein; (c) placing the bottom surface of the thumb in the center portion of the front side of the handle with the index finger supporting the backside of the handle; (d) applying adequate sustained pressure to the located trigger point of the body with the second end of the handle; and (e) repeating step (d) until adequate treatment is applied to all predetermined trigger points areas of the body.

17. A method of applying pressure to small stripping areas of the human body utilizing hand-held device comprising a handle, defined by an inner edge, lower edge, first end and opposite second end; a thumb support member being integrally connected to the first end of the handle in a substantially perpendicular relationship to a longitudinal axis of the handle-and protruding outwardly laterally along the inner edge near a distal end of the first end therefrom to a sensor tip portion having a semi-spherical shape extending beyond an outer peripheral edge of the thumb support member forming an apex point, the sensor tip portion being adapted to apply direct pressure to predetermined treatment areas on the body and the thumb support member being dimensioned to support the circumference of a user's thumb wherein while in use the user thumb rests in a natural position parallel to the plane of the palm and a groove formed in said thumb support, said groove forming an indentation and being of a width that extends along a substantial width between the edges of said thumb support in order to accommodate the width of the user's thumb, protruding outwardly laterally along an inner edge near a distal end of the first end therefrom, the method comprising; (a) locating a small stripping area on the human body; (b) grasping the handle with the pinky, middle, index, and ring fingers of the user's hand with the handle in a horizontal position in the palm of the user's hand, (c) placing the outer side of the thumb diagonally across the lower portion of the thumb support member; (d) applying gliding pressure to the located small stripping area of the body with the outer curved peripheral edge of the thumb support member from the point of origin of the muscle to the point of insertion of the muscles; and (e) repeating step (d) until adequate treatment is applied to all predetermined small stripping areas of the body.

18. A method of applying pressure to large stripping areas of the human body utilizing a hand-held device comprising a handle, defined by an inner edge, lower edge, first end and opposite second end; a thumb support member being integrally connected to the first end of the handle in a substantially perpendicular relationship to a longitudinal axis of the handle-and protruding outwardly laterally along the inner edge near a distal end of the first end therefrom to a sensor tip portion having a semi-spherical shape extending beyond an outer peripheral edge of the thumb support member forming an apex point, the sensor tip portion being adapted to apply direct pressure to predetermined treatment areas on the body and the thumb support member being dimensioned to support the circumference of a user's thumb wherein while in use the user thumb rests in a natural position parallel to the plane of the palm and a groove formed in said thumb support, said groove forming an indentation and being of a width that extends along a substantial width between the edges of said thumb support in order to accommodate the width of the user's thumb, protruding outwardly laterally along an inner edge near a distal end of the first end therefrom, the method comprising: (a) locating a large stripping area on the human body; (b) grasping the upper portion of the handle in the palm of the hand with the middle, ring, pinky, and index fingers supporting the backside of the upper portion of the handle near the point of integration between the handle and the thumb support member; (c) placing the bottom surface of the thumb in the center portion of the thumb support member; (d) applying gliding pressure to the located large stripping area of the body with the inner curved peripheral edge of the device from the point of origin of the muscle to the point of insertion of the muscles; and (e) repeating step (d) until adequate treatment is applied to all predetermined large.

* * * * *